US006003944A

United States Patent [19]

Glockl

[11] Patent Number: 6,003,944

[45] Date of Patent: Dec. 21, 1999

[54] BAR STOOL

[76] Inventor: Josef Glockl, Ammerseestrasse 6, D-85551 Kirchheim, Germany

[21] Appl. No.: 09/089,090

[22] Filed: Jun. 2, 1998

[30] Foreign Application Priority Data

Jun. 2, 1997 [DE] Germany ..... 297 09 558 U

[51] Int. Cl.[6] ..... A61G 15/00

[52] U.S. Cl. ..... 297/337; 297/313; 297/314; 297/423.1; 297/423.38; 297/423.36

[58] Field of Search ..... 297/337, 313, 297/314, 461, 423.1, 423.12, 423.36, 423.38

[56] References Cited

U.S. PATENT DOCUMENTS

| | | | |
|---|---|---|---|
| 904,034 | 11/1908 | Whitlow | 297/423.1 X |
| 2,529,780 | 11/1950 | Miller | 297/423.1 X |
| 3,376,068 | 4/1968 | Walkinshaw | 297/423.38 |
| 3,458,234 | 7/1969 | Bates | 297/423.38 |
| 4,099,697 | 7/1978 | Von Schuckmann | 297/314 X |
| 4,130,263 | 12/1978 | Roericht | 297/461 |
| 4,348,051 | 9/1982 | Boucher | 297/423.1 X |
| 4,623,195 | 11/1986 | Avella | 297/423.98 |
| 4,884,842 | 12/1989 | Finkelstein | 297/337 X |
| 5,524,967 | 6/1996 | Glockl | 297/314 |
| 5,551,753 | 9/1996 | Glockl | 297/314 |
| 5,570,929 | 11/1996 | Glockl | 297/313 |
| 5,576,304 | 11/1996 | Glockl | 297/314 |
| 5,590,930 | 1/1997 | Glockl | 297/313 |

*Primary Examiner*—Peter M. Cuomo
*Assistant Examiner*—Rodney B. White

[57] ABSTRACT

A bar stool having a seat portion, an intermediate portion and a base portion, wherein the intermediate portion has a spring construction and is mounted tiltably and returnably on the base portion. The intermediate portion comprises a central pillar and a spring arrangement which are connected to distribute the weight between the seat portion and the base portion.

28 Claims, 5 Drawing Sheets

BAR STOOL

FIELD OF THE INVENTION

The present invention relates to a stool and more specifically to a bar stool.

BACKGROUND OF THE INVENTION

A typical form of bar stool comprises a seat portion, an intermediate portion and a base portion. Such a stool however suffers from the disadvantage that the user of the stool, sits thereon in a highly static position. In the course of long evenings spent on such a bar stool the back muscles of the occupants of the stool suffer from fatigue whereby the occupant of the stool progressively assumes a detrimental seating posture.

During the day, a large part of the population works in offices or the like involving activity in a seated position, which also contributes to degeneration of the back muscles. If in particular such people who are already suffering from weakened or degenerated back muscles now also sit on static bar stools, for example, in the evening, then there is even a greater tendency of the stool occupant to adopt a detrimental sitting posture, with the consequence of further back pains and similar svmptoms resulting thezafrom. Continuous and incorrect loading on the intervertebral disks results in the blood supply thereto being extremely poor, which can result in permanent back damage. A further disadvantage when sitting on a bar stool is that the legs hang inclined downwardly and thus most occupants of bar stools have a tendency to adopt a posture involving a hollow bask. If that posture is found to be uncomfortable, the stool occupant then rests against the bar itself, which in turn results in the intervertebral disks being subjected to a very one-sided loading.

SUMMARY OF THE INVENTION

An object of the present invention is to improve a bar stool in such a way that it at least encourages a healthy sewted posture for the occupant.

Another object of the present invention is to provide a bar stool which can provide a therapeutic effect for the person using the stool.

Still another object of the present invention is to provide a ba stool which, while being of a simple structure, can at least contribute to the occupant of the stool achieving at least a more-or-less substantially fluid condition on f stool, without the producing muscular lock up due to prolonged immobility.

SUMMARY OF THE INVENTION

In accordance with the principles of the present invasion the foregoing and other objects are attained by a bar stool comprising a seat portion, a base portion, and ar intermediate portion operatively dispcsed between the seat portion and the base portion to interconnect the same. The intermediate portion has a sprurg construction and is mounted tiltably and returnably on the base portion.

By virtue of the sprung intermediate portion the bar stool swings even upon the slightest movement on its longitudinal axis so that the back muscles of the occupant of the stool remains constantly in movement end in addition the intervertebral disks are not subjected to a static loading.

By virtue of the fact that the intermediate portion is mounted tiltably and returrably on the base portion, the user is always slightly rockng to ar fro. As a result the back musculature of the ussr also always remains slightly in motion and accordingly the intervertebral disks receive a good supply of blood.

In a preferred feature of the present invention the base portion has a fixed or stationary shaft. A pivot point between the base portion and the intermediate portion is disposed at the upper end of the shaft.

The presence of the fixed shaft ensures that the pivot point is not too far away from the seat surface and thus the rocking or swinging movement is limited to an appropriate advantageous extent. If in cntrast the poin about which the rocking movement were to take place were to be at the ground or floor, the rocking movement in the case of a bar stool would be excessive and it would no longer be possible for the stool to be safely used by persons unaccustomed to such arrangement.

A further preferred feature of the present invention provides that a foot ring is carried on the shaft at a predetermnined spacing from the ground or floor and thus from the bottom of the stool. The foot ring can be fixedly attached to the shaft and is thus virtually stationary. The occupant of the stool can thus put his feet on the foot ring and, in spite of the pelvic area and the upper body of the stool occupant rocking to and fro, the occupant still enjoys a secure steady seated posture by virtue of his putting his feet on the foot ring In accordance with a preferred feature of the present invention the foot ring is adjustable with respect to the height on the shaft, thereby permitting optimum adjustment to match the requirements of the user.

A preferred structure provides that the intermediate spring portion comprises a central pillar and a spring arrangement, with the central pillar and the spring arrangement being connected in series in the flow of force of the seat welght between the seat portion and the base portion. The fact that the central pillar and the spring arrangement are connected in series in the above-indicated fashion means that the central pillar can be of such a structure as to be adjustable in respect of height without the springing effect about the longitudinal axis being adversely affected.

In this advantageous construction it is also preferable for the central pillar and the spring arrangement to be disposed in concentric relationship, with a bearing guide bsing operatively disposed between the central pillar and the spring arrangement. The concentric arrangement of the central pillar and the spring arrangement makes it possible to provide for the series arrangement of the central pillar and the spring arrangement, in a relatively compact structural configuration. That can be of great significance for the reason that, as already mentioned above, the point about which the pivotal movement occurs may not be too far away from the seat surface, and thus simply arranging the central column and the spring arrangement in succession would cause the point about which the pivotal movement occurs to be srhifted too far in the direction of the base portion.

Preferably the spring arrangemet comprises a dynamic spring mounting means and a static spring mounting means, with a spring operatively disposed between the dynamic and static spring mounting means. This relatively simple structure makes it possible to use an ordinary spring in the form of a standard component.

Advantageously the central pillar is in the form of a spring pillar which is adjustable with respect to its length, such as for example a gas spring unit, and has at least one vertical guide trak co-operating with the bearing guide.

The bearing guide advantageously includes a two-part bearing means which is arranged at a spacing with respect to height, with balls or rollers preferably being used as the bearing elements, In a particularly preferred construction according to the present invention the bearing elements are pressed against the guide track under a spring loading. When bearing elements which are not subjected to a spring loading are used, manufacturing inaccuracies and tolerances can be very substantially perceived in the rocking and swinging movement of the stool, and have a highly detrimental and disturbing effect when an occupant of the stool is sitting thereon in an active-dynamic fashion involving the rocking movement of the stool.

It is desirable for at least two bearing elements to be arranged on the guide track for each bearing means.

In that arrangement the bearing elements are advantageously held in bearing element mountings, while the bearing element mountings may press the bearing elements against the guide track either by wav of compression springs or by way of an elastically deformable region or by way of an elastically deformable projection. it will be seen therefore that the compression springs or the zlastically deformable region or the elastically deformable projections urge the bearing elements radially inwardly towards the guide track.

In a preferred feature the guide track comprises a tube having a first end connected to the lower end of the spring pillar and a second end connected to the dynamic end of the spring mounting arrangement.

It is further preferable for a plain bearing bush to be arranged between the guide track tube and the spring pillar which is preferably in the form of a gas spring unit. In the case of active-dynamic continuous rocking and swinging movements about the longitudinal axis of the intermediate portion, it is primarily the spring arrangement that springs, with the gas spring unit being involved in that movement only to a minimal extent, so that it is primarily the plain bearing bush that is involved in the displacement in respect of height.

The bearing guide is preferably arranged on a support leg main body in which the bearing mountings are radially displaceably held under a spring loading. The provision of the spring-loaded bearing elements contributes to compensating for dimensional inaccuracies and tolerances, and this structure therefore provides for uniform, trouble-free and virtually noiseless swinging movement about the longitudinal axis of the intermediate portion of the stool.

In a preferred feature the support leg main body can be fitted on to the shift on the base portion by way of a spline connection.

Preferably, the spacing between the dynamic and the static spring mountings is adjustable. For that purpose, a rotatable union nut is provided as a spring support means on the support leg maln body, by way of which nut the spring of the spring arrangement is prestressable. The prestressing of the spring permits the stool to be adjusted to the weight of the people using it so that the seat surface afforded by the seat portion does not move downwardly to an unacceptably great degree or an unacceptably slight degree, when a person sits thereon. As noted above that prestressing mechanism is advantageously formed by way of the rotatable urnon nut on the support leg main body, by way of which the stress of the spring can be increased or reduced, by rotation of the union nut.

The stool advantageously has a return device in the form of a swing connector formed by an elastic material-metal composite unit such as a rubber-metal swing connector, between the intermediate portion and the base portion, and it can be adjusted in terms of the return force, for example by way of a hand wheel.

Further objects, features and advantages of the present invention will be apparent from the followin; description of preferred embodiments thereof.

The present invention will become more fully understood from the detailed description given hereinbelow and the accompany8ing drawings which are given by way of illustration only, and thus are not limitative of the present invention, and wherein:

DESCRIPTION OF THE PREFERRED EMBODIMENTS

Figure 1:
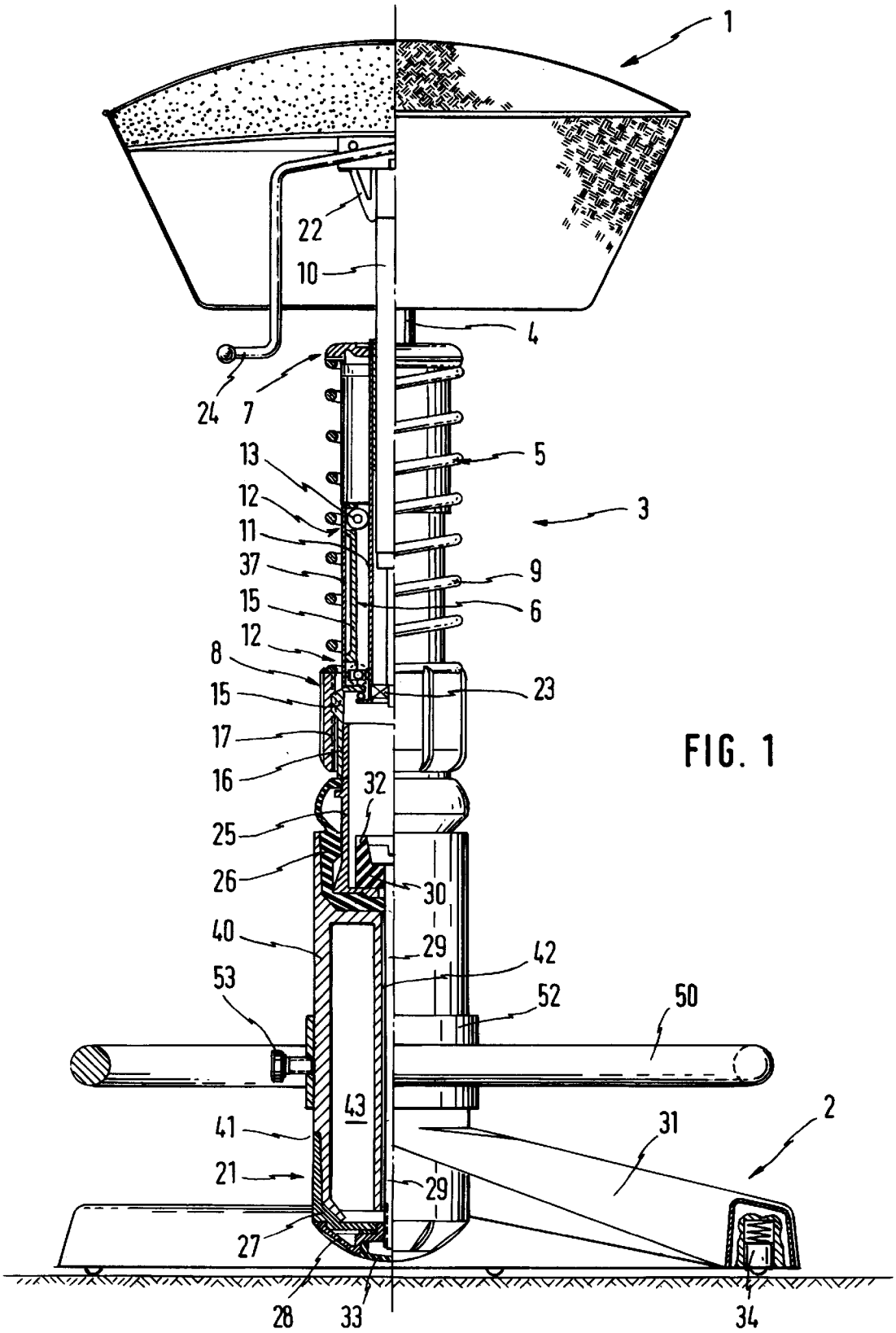
FIG. 1 is a side view, half in section, of the rocking bar stool.

Referring firstly to FIG. 1, shown therein is a side view, half in section, of a rocking bar stool comprising a seat portion 1, an intermediate portion 3 and a base portion 2. The intermediate portion 3 has a central column or pillar 4 and a spring arrangement 5 and is held tiltably and returnably at its lower end in the base portion 2. The central pillar 4 is in the form of a height-adjustable spring pillar 10, generally In the form of a gas spring unit. The seat portion 1 is fixedly connected to the spring pillar 10 by way of a push-in connection 22 and can rotate about the longitudinal axis (not referenced) of the spring pillar 10 by virtue of the provision of a bearing 23 disposed at the lower end of the spring pillar 10. For adjustment with respect to the height of the seat surface 1, and arranged at the underside thereof is a lever 24 which, upon actuation, acts on the spring pillar 10 in such a way that it can be adjusted with respect to height in a known manner. The central pillar 4 also includes a vertical guide track 11 which is in the form of a tube surrounding the spring pillar 10 and which is rot atably connected at the lower end to the spring pillar 10 by way of the bearing 23.

To achieve the desired active-dynamic seating characteristics the spring arrangement 5 is connected in series subsequently to the central pillar 4 in the flow of force of the seat weight between the seat portion 1 and the bass portion 2. A reversed arrangement in which the flow of force occurs firstly by way of the spring arrangement 5 and then by way of the central pillar 4 is equally possible.

The spring arrangement 5 comprises a static spring mounting 8, a spring 9 shown in the form of a coil spring and a dynamic spring mounting 7. The dynamic spring Mounting 7 is fixedly connected to the upper end of the guide track 11.

A bearing guide 6 is operatively provided between the spring arrangment 5 and the guide track 11, for the relative movement between the central pillar 4 and the spring arrangement 5. In the illustrated embodiment the bearing guide 6 comprises two bearing means 12 which are held in the upper holding part of a support leg main body 15. The support leg main body 15 forms the lower end of the central pillar 4 and is fitted by way of a spline connection 16 onto the structure of the base portion 2. In its lower region the support leg main body 15 has a male screwthread onto which is screwed a union nut 17 which serves at the same time as a support means of the spring 9. The spring 9 can be prestressed by the union nut 17 and in that way the distance by which the seat surface of the seat portion 1 moves downwardly when the seat surface is loaded can be matched to the weight of the person using the stool.

The intermediate portion 3 is fitted by way of the spline connection 16 onto a return device 21 on the base portion 2. The return device 21 is in tha form of a rubber-metal swing connection and comprises a substantially tubular upper portion 25 whose upper end serves for making the spline connection 16, and a lower portion 27 which is fixedly secured to an arm 31 of thebase portion 2. A shaft portion 40 is fitted onto the lower portion 27. The shaft portion 40 is accommodated at the bottom within the lower portion 27 and at the top embraces the upper portion 25 in a cup-like configuration. An elastic material 26 is arranged between the too of the shaft portion 40 and the upper portion 27. The elastic material 26 is arranged both between the ends and also between the side walls. The upper portion 25, the shaft portion 40 and the lower portion 27 are connected together by way of a screw 29, while the return device 21 cen be prestressed by way of an adjusting nut 28 co-operating with the screw 29, and thus the return force can be adjusted. In an alternative configuration as shown in FIG. 1, arranged between the heed of the screw 29 and the upper portion 25 is a further elastic element 30 which makes the characteristics of the return device 21 softer and more comfortable.

A foot ring 50 is fixed to the cylindrical outside of the shaft portion 40 by way of a sleeve 52. The sleeve 52 has a screwthreaded bore with a setting screw 53 in srewthreaded engagement therein, so that the foot ring 50 can be arrested or fixed in position on the shaft portion 40 by way of the scew 53. Releasing the screw 53 permits the fact ring 50 to be adjusted in respect of height along the length of the shaft portion 40.

The base portion 2 is generally in the form of an almost closed ring on which the return device 21 and thus the intermediate portion 3 and the seat portion 1 are mounted centrally by way of the arm 31. Wlen a loading is applied the arm 31 is elastically deformed so that the stool is pressed against the floor or ground by way of a friction-promoting contact device 33 at the lower end cm the return device 21.

Arranged in the annular base portion 2 of the stool are rollers or balls 34 which are resiliently retracted into the base portion 2 when a loading is applied. It would also be possible to use so-called rollers or balls in accordance with the German DIN standard which are of such a design as to be locked or arrested in the resiliently extended condition, which permit displacement of the stool upon a light loading being applied, and which are resiliently retracted into the base portion 2 when fully loaded.

Figure 2:
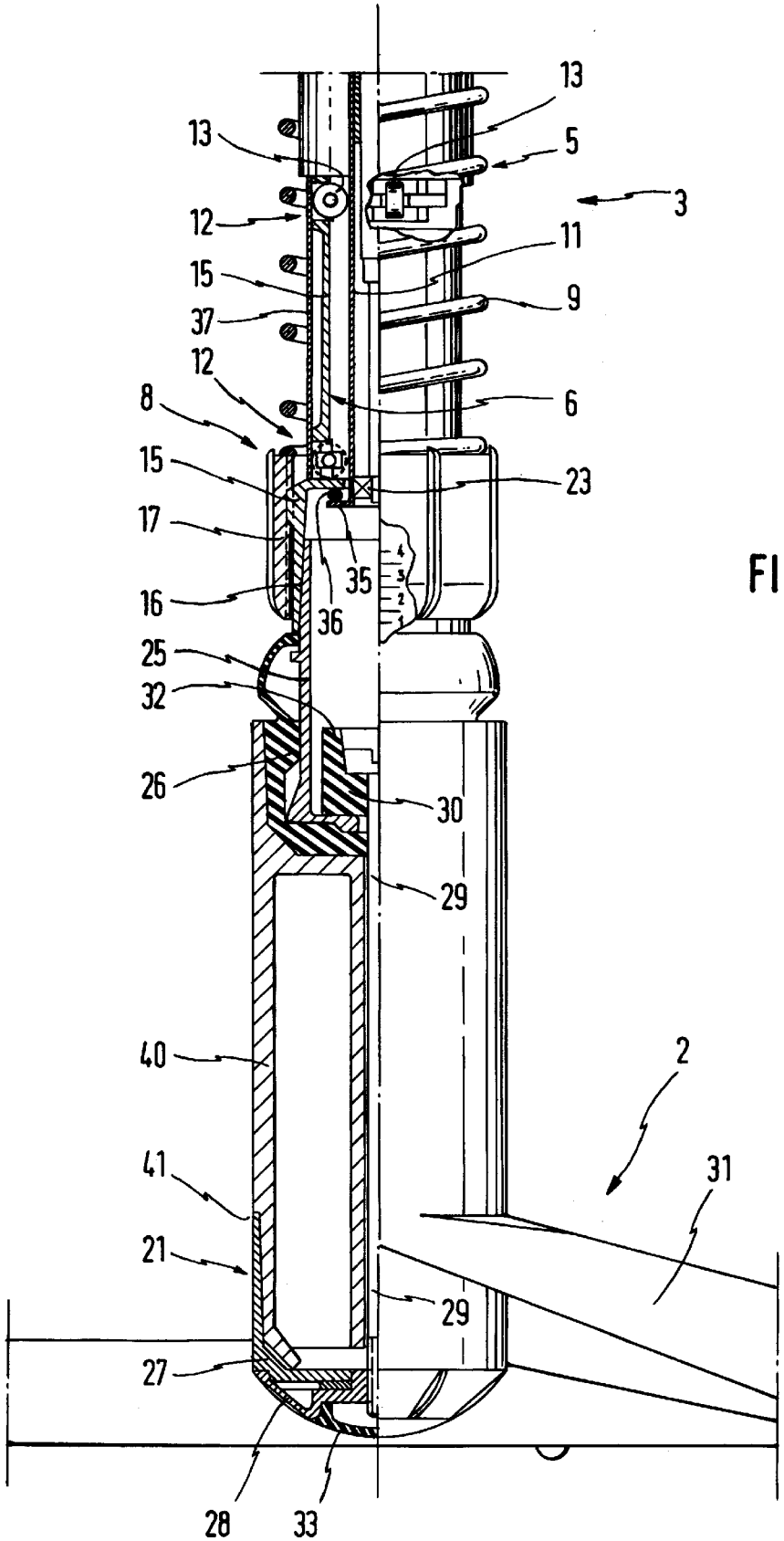
FIG. 2 is a view on a larger scale of the lower part of the intermediate portion of the bar stool of FIG. 1.

FIG. 2 shows the lower part of the intermediate portion 3 and the return device 21 of the rocking bar stool of FIG. 1 on an enlarged scale. The foot ring 50 Is not shown here. Upon active-dynamic swinging movement about the longitudinal axis (not idntified) orf the intermediate portion 3, a relative movqment occurs between the guide track 11 and the spring arrangement 5. That relative movement is made possible by virtue of the above-mentioned bearing guide 6 between the spring arrangement 5 and the guide track 11. That bearing guide 6 is described in greater detail with reference to FIGS. 3 and 4*a*–4*c* hereinafter. In the extended condition the travel of the spring 9 is limited by an abutment 35 at the lower end of the vertical guide track 11. The abutment 35 co-operates with a step or shoulder on the support leg muain body 15. In order to make the travel limitation effect upwardly soundless, a rubber ring 36 is operatively disposed beaten the support leg main body 15 and the abutment 35. An elastic abutment 32 is provided for travel limitation purposes in a downward direction, above the head of the screw 29.

Figure 3:
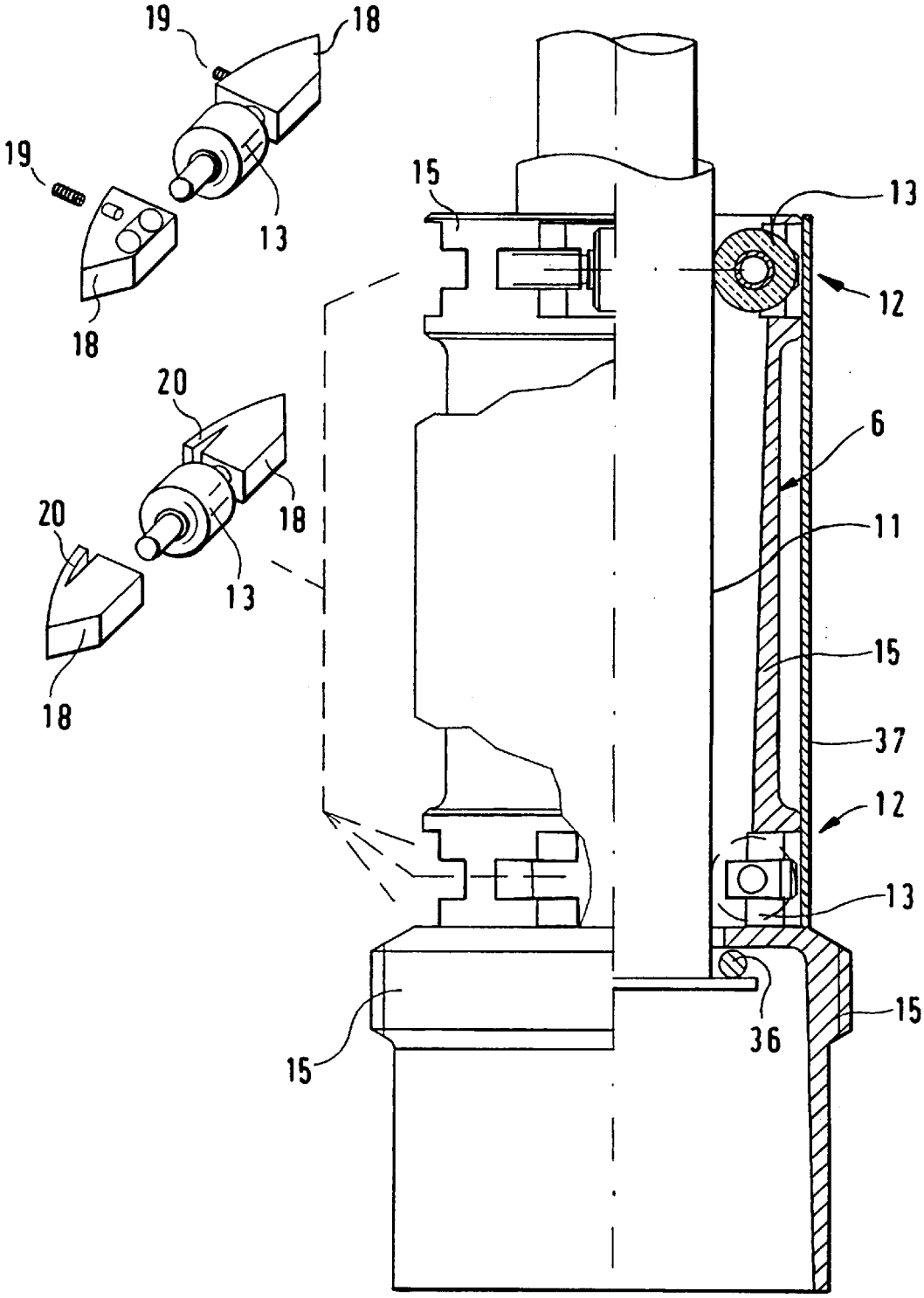
FIG. 3 shows the region of the intermediate portion with a bearing guide.

Reference will now be made to FIG. 3 showing the part of the intermediate portion 3, in which the bearing guide 6 is disposed. In the illustrated embodiment the bearing guide 6 comprises two bearing means 12 which are held in the support leg main body 15 and which cooperate with the guide track 11. For each plane the bearing means 12 each have four bearing elements 13 which are distributed around the periphery of the guide track 11, which bearing elements 13 can be either in the form of roilers or balls (see in that respect also FIG. 4a). The illustrated embodiment provides that the bearing elements 13 are in the form of rollers, the roller shafts or spindles of which are accommodated at both sides in bearing element mountings 18. The bearing element moutntings 18 are held radially displaceably to a certain degree in the support leg main body 15 and are spring-loaded in the direction of the guide track 11. Two alternative configurations are shown for providing for the spring loading. In the first alternative configuration the bearing element mountings 18 are supported by way of compression springs 19 against a tube 37 surrounding the support leg main body 5 and thereby arce the bearing elements 13 in the direction of the guide track 11. The tube 37 is fitted from above over the upper tubular region of the support leg main body 15 and co-operates with the support leg main body 15 for fixing bearing means 12.

In the second alternative configuration each of the bearing element mountings 18 has a respective elastic projection 20 which, by virtue of elastic deformation thereof, also urges the bearing element mountings 18 and therewith the bearing elements 13 against the guide track 11.

Figure 4A:
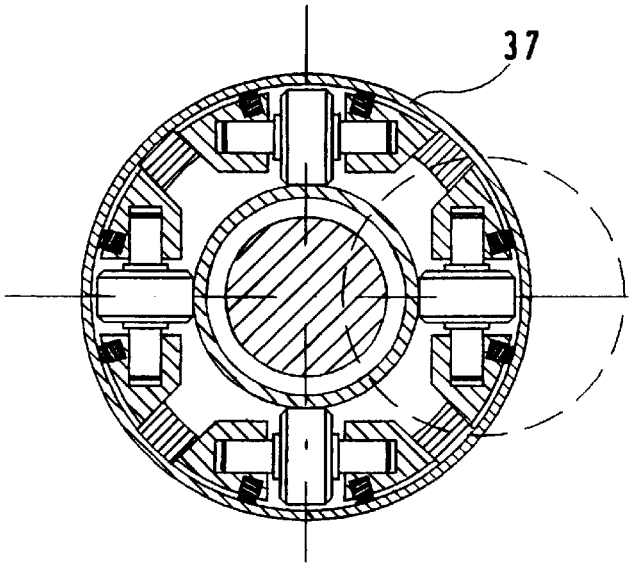
FIG. 4*a* is a view in cross-section through the intermediate portion in the region of tne bearing guide.

FIG. 4*a* is a view in section through the bearing means 12 already described above with reference to FIG. 3, and FIG. 4*b* shows a portion on an enlarged scale from FIG. 4*a,* that alternative configuration showing the spring loading applied to the bearing elements 13 by way of compression springs 19 which bear against the tube 37.

Figure 4C:
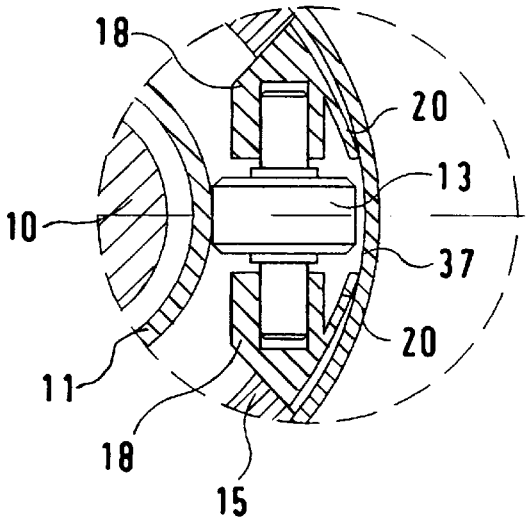
FIG. 4*c* shows an alternative form of the FIG. 4*b* structure.
Figure 4B:
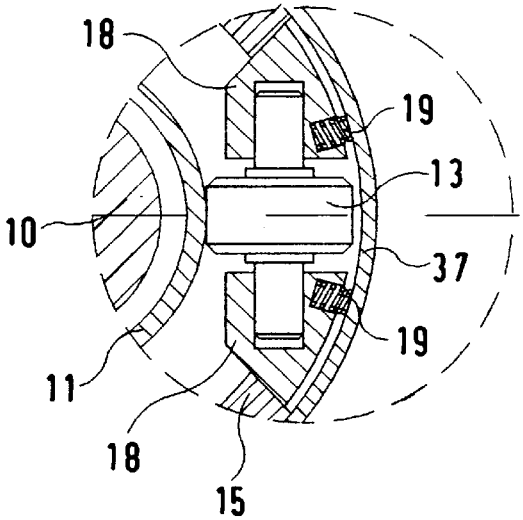
FIG. 4*b* shows a part of the FIG. 4*a* structure on an enlargad scale.

FIG. 4*c* shows the same part as in FIG. 4*b,* but illustrating another alternative configuration. The FIG. 4*c* structure provides that the bearing element mountings 18 have the elastic projection 20 which is also supported against the tube 37 and thus urges the bearing elements 13 against the guide track 11.

Figure 5:
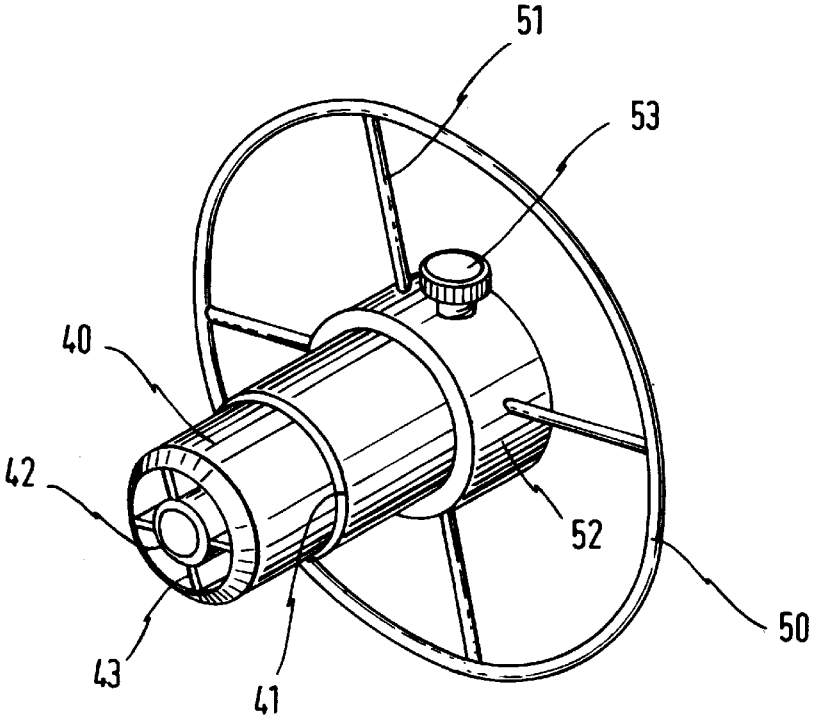
FIG. 5 is a perspective view of a shaft and a foot ring of an embodiment of the stool according to the present invantion.
Figure 6:
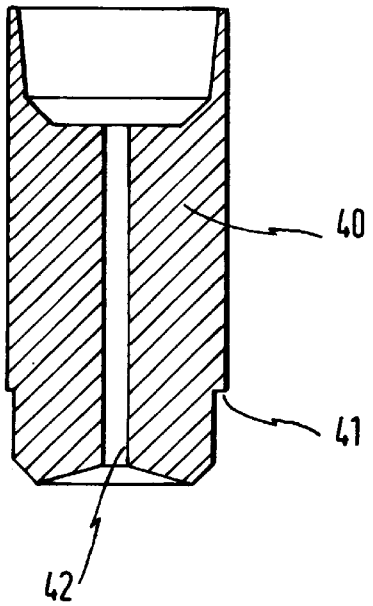
FIG. 6 is a view in cross-section through a alternative form of the shaft.

Reference is now made to FIG. 5 showing a perspective view of the shaft portion 40 with a foot ring 50 fitted thereon. The shaft portion 40 is of a substantially cylindrical configuration and towards its lower end has a step or shoulder 41. The shaft 40 can be fitted with its lower end with an accurate fit into the lower portion 27, thus affording overall a smooth cylindrical outside surface. At the upper end (not visible in FIG. 5) the shaft portion 40 is of a cup-shaped configuration to receive the elastic material 26 and the upper portion 25.

In the center the shaft portion 40 has a passage as indicated at 42 for receiving the screw 29 which serves for prestressing and adjusting the adjusting device 21.

The shaft portion 40 is generally in the form of an aluminum die casting, while stiffening ribs 43 can additionally be providsd between the outside wall portion thereof and the passage 42.

The foot ring 50 is fitted on the shaft portion 40 at the outside peripherv thereof by way of the sleeve 52, while the sleeve 52 can be arrested or locked to the shaft portion 40 by way of the setting screw 53. The foot ring 50 is ccnnected to the sleeve 52 by way of struts 51 and is generally of diameter of about 500 mm.

FIG. 16 shows a further embodiment of the shaft portion 40 which in this case is in the form of an aluminum turned memnber of solid mnaterial. The shaft portion 40 likewise has the passage 42 for the screw 29 and the step or shoulder 41. The shot portion can be of various lengths. By virtue of the fact thet it can be readily fitted into the lower portion 27, adaptation of the height of the bar stool to the wishes of the person using it is readily possible, over the length of the shaft portion 40. It is only necessar for the screw 29 to be adapted to the length of the shaft portion.

It will be noted that the invention is not limited to the above-described emnbodimnents but includes any bar stool which provides for active-dynamic sitting thereon in the manner described hereinbefore in accordance with the invention.

It will be appreciated therefore that the above-described structures of a bar stool according to the invention have been set forth solely by way of example and illustration of the principles of the invention and that various other modifications and alterations may be made therein without thereby departing from the spirit and scope of the invention.

What is claimed is:

1. A bar stool comprising a seat portion, a base portion, an intermediate portion operatively disposed between the seat portion and the base portion, the intermediate portion having a spring construction comprising a central pillar and a spring arrangement, said central pillar and said spring arrangement being disposed in a concentric relationship and including a bearing guide operatively disposed between the central pillar and said spring arrangement, whereby the central pillar and the spring arrangement are connected in the distribution of weight between the seat portion and the base portion, and means mounting the intermediate portion tiltably and returnably on the base portion.

2. The bar stool as set forth in claim 1, wherein the base portion has a shaft fixed thereto.

3. The bar stool as set forth in claim 2 including a foot ring carried on the shaft at a spacing from the ground.

4. A bar stool as set forth in claim 3 including means for the heightwise adjustment of a position of the foot ring on the shaft.

5. The bar stool as set forth in claim 1, wherein the spring arrangement includes a dynamic spring mounting means and a static spring mounting means, with a spring operatively disposed between the dynamic and the static spring mounting means.

6. The bar stool as set forth in claim 5, wherein the bearing guide is arranged between the central pillar and the static spring mounting means.

7. The bar stool as set forth in claim 1, wherein the central pillar is a spring pillar with at least one vertical guide track cooperating with the bearing guide.

8. The bar stool as set forth in claim 7, wherein the spring arrangement comprises a dynamic spring mounting means, a static spring mounting means and a spring operatively disposed therebetween, and wherein the guide track comprises a tube having a first end connected to a lower end of the spring pillar and a second end connected to a dynamic spring mounting.

9. The bar stool as set forth in claim 8, including a plain bearing bush between the guide track tube and the spring pillar.

10. The bar stool as set forth in claim 8, including means for adjusting the spacing between the dynamic and the static spring mounting means.

11. The bar stool as set forth in claim 7 including means for adjusting the spring pillar with respect to its length.

12. The bar stool as set forth in claim 1, wherein the bearing guide includes at least a two-part bearing means arranged at a spacing with respect to height.

13. The bar stool as set forth in claim 12, wherein the bearing means has a plurality of bearing elements.

14. The bar stool as set forth in claim 13, wherein the bearing elements comprise rollers.

15. The bar stool as set forth in claim 13, wherein the bearing elements comprise balls.

16. The bar stool as set forth in claim 13, including spring-loading means adapted to press the bearing elements against the guide track.

17. The bar stool as set forth in claim 12, wherein the bearing means has at least four bearing elements at the periphery of the guide track.

18. The bar stool as set forth in claim 13, including bearing element mountings holding the bearing elements.

19. The bar stool as set forth in claim 18, including a support leg main body and means mounting the bearing element mountings radially displaceably in the support leg main body.

20. The bar stool as set forth in claim 18, including compression springs adapted to urge the bearing element mountings towards the guide track for pressing the bearing elements against the guide track.

21. The bar stool as set forth in claim 18, wherein the bearing element mountings have an elastically deformable region and are adapted to press the bearing elements towards the guide track by virtue of an elastic deformation thereof.

22. The bar stool as set forth in claim 18, wherein the bearing element mountings have an elastically deformable projection adapted to press the bearing elements towards the guide track.

23. The bar stool as set forth in claim 18, wherein the bearing element mountings are adapted to move to a predetermined extent between a tube of a static spring mounting means and the guide track.

24. The bar stool as set forth in claim 8, including a support leg main body on which the bearing guide is arranged.

25. The bar stool as set forth in claim 24, including a spline connection adapted to fit the support leg main body onto the base portion.

26. The bar stool as set forth in claim 1, including a rotatable union nut as a spring support means on a support leg main body, the spring of the spring arrangement being prestressable by said union nut.

27. The bar stool as set forth in claim 1, including a return device in the form of a rubber-metal swing connector disposed between the intermediate portion and the base portion.

28. The bar stool as set forth in claim 27, including means for adjusting the return force of the return device.

* * * * *